United States Patent [19]

Hanlet

[11] 4,341,976

[45] Jul. 27, 1982

[54] DISPLAY SYSTEM

[75] Inventor: Jacques M. Hanlet, Loxahatchee, Fla.

[73] Assignee: Alpha-Omega Development, Inc., Loxahatchee, Fla.

[21] Appl. No.: 121,918

[22] Filed: Mar. 5, 1980

[51] Int. Cl.[3] ..... H01J 1/20; H01J 61/09; H01J 61/42

[52] U.S. Cl. ..... 313/210; 313/484; 313/491; 315/169.4

[58] Field of Search ..... 313/209, 213, 216, 217–218, 313/230, 210, 484, 182–187, 491; 315/169.4; 29/25.1, 25.11, 25.13, 25.14, 25.16

[56] References Cited

U.S. PATENT DOCUMENTS

| | | | |
|---|---|---|---|
| Re. 17,712 | 6/1930 | Schmierer . | |
| 1,830,163 | 11/1931 | Gray . | |
| 1,925,693 | 9/1933 | Gray . | |
| 1,991,479 | 2/1935 | Williams | 313/216 X |
| 2,002,551 | 5/1935 | Schmierer . | |
| 2,147,426 | 2/1939 | Brown . | |
| 2,595,617 | 5/1952 | Toulon . | |
| 2,971,109 | 2/1961 | Jackson et al. | 313/188 |
| 3,042,823 | 7/1962 | Willard | 313/6 |
| 3,089,054 | 5/1963 | Walsh et al. | 313/209 X |
| 3,249,802 | 5/1966 | Nakajo et al. | 315/167 |
| 3,334,269 | 8/1967 | L'Heureux | 315/58 |
| 3,476,970 | 11/1969 | Gillies et al. | 313/216 X |
| 3,559,190 | 1/1971 | Bitzer et al. . | |
| 3,662,214 | 5/1972 | Lustig | 313/209 X |
| 3,743,879 | 7/1973 | Kupsky | 313/484 |
| 3,899,707 | 8/1975 | Sasaki et al. | 313/220 |
| 3,952,221 | 4/1976 | Kamegaya et al. | 313/209 X |
| 3,983,445 | 9/1976 | Yasuda et al. | 313/485 |
| 3,986,074 | 10/1976 | Watanabe et al. | 313/485 |

*Primary Examiner*—Marvin L. Nussbaum
*Attorney, Agent, or Firm*—Morton J. Rosenberg

[57] ABSTRACT

A monochromatic and polychromatic display system (10) which is operative by the generation of ultraviolet energy impinging on fluorescent material compositions (54) in order to create electromagnetic wave generation within the visible bandwidth of the electromagnetic spectrum through fluorescent excitation of fluorescent material (54). The operative ultraviolet energy produced results from the ionization of metallic atoms from a metallic coating (28) applied to cathode opening sidewalls (26) of a cathode mechanism (12). The display system (10) includes a matrix of cathode openings (22) formed in a cathode plate member (14). The cathode openings (22) define the cathode opening sidewalls (26) which have a metallic coating (28) applied thereto. The sidewall metallic coatings (28) and additionally, the metallic coating annular portion (30) of each hollow cathode cavity are coupled to a next succeeding cathode element in a linear column direction (32). A matrix of anode elements (46) are mounted below the cathode plate member (14) and are axially aligned with the cathode openings (22). The display system (10) is formed into a monolithic structure which includes an internal chamber (66) within which an inert or combination of inert gases is introduced. Fluorescent material compositions (54) are positionally located in aligned relation above cathode openings (22). Electrical energization of the cathode elements and the anode elements (46) results in ionization of metal atoms emitted from the metallic coating (28). The ionization process provides for ultraviolet radiation which is directed to the fluorescent material composition (54).

58 Claims, 5 Drawing Figures

FIG. 2
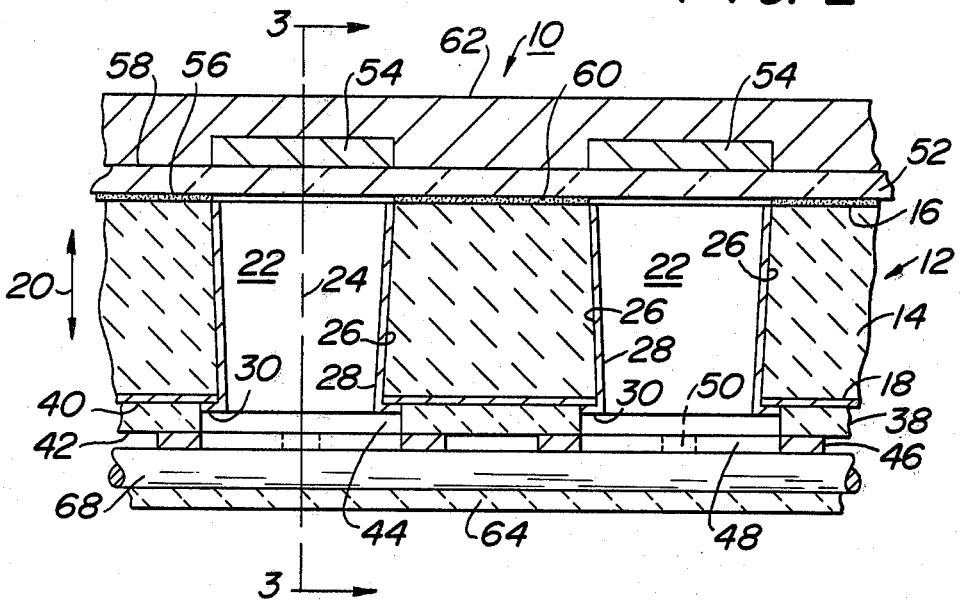
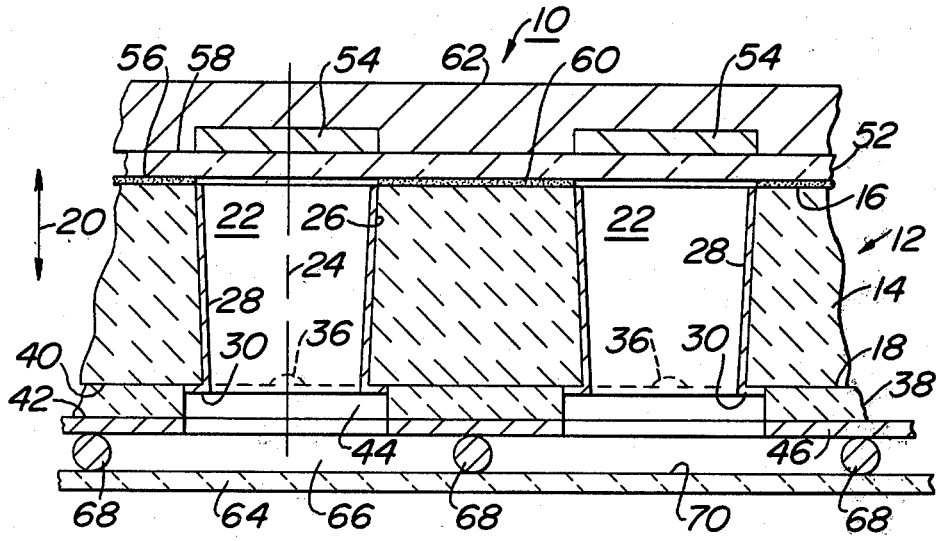
FIG. 3

DISPLAY SYSTEM

BACKGROUND OF THE INVENTION

1. Field of the Invention

This invention relates to monochromatic and polychromatic display systems. In particular, this invention relates to display systems which provide matrix displays resulting from the conversion of long wave ultraviolet photons into visible light energy through the fluorescent excitation of fluorescent material compositions, such as synthetic Phosphors. In particular, this invention relates to displays where ultraviolet radiation is produced by the ionization of metal atoms through an electric field applied internal to minute cavities in the form of hollow cathodes. Still further, this invention relates to a display system where the long wave ultraviolet photons are directed in a constrained manner from one end of hollow cathode cavities for impingement through an ultraviolet transparent glass composition plate onto a fluorescent material composition.

2. Prior Art

Gas discharge display systems are known in the art. Although the subject display system cannot truly be classified as a gas discharge display, such gas discharge systems are believed to be the closest prior art to the subject system. In prior art gas discharge systems, a plurality of plasma displays may be attained either as alpha-numeric displays having generally linearly or arcuately segmented cathodes, or dot matrix displays. Such prior art systems are generally based on the ionization of a noble gas or gas mixtures. In such prior art systems, the ionization occurs between two flat and parallel electrodes with generally the anode electrode being transparent to light generated in the neighborhood of the cathode electrode.

Numerous disadvantages are apparent when such prior art gas discharge display systems are utilized. In such prior art gas discharge systems, the visible glow from the cathode surface is visibly stable only if the totality of the surface area of the cathode is uniformly covered by the glow and the cathode surface has uniform properties. In the event that either of these two conditions is not present, the visible light will provide a flickering effect which is deleterious to the eye of an observer.

Another major disadvantage of such prior art gas discharge systems is that the operating life of such prior art systems is dependent on the sputtering rate from the cathode electrode. This is due to the fact that the sputtering of the material from the cathode electrode generally deposits itself on the anode electrode, thus obviously reducing the anode electrode's transparency. The sputtering also reduces the gas pressure by physical adsorption of the filling gas. In order to provide an acceptable operating light of such prior art systems, such are generally operated at lower than maximum current density thereby resulting in only a less than optimum light output.

Some prior art work has investigated the generation of polychromatic systems based on the conversion of ultraviolet photons into visible light with Phosphor compositions. One such prior work is reported by V. Van Gelder, Proc. IEEE, Vol. 61, No. 7, July 1973, is directed to the utilization of ultraviolet photons emitted by recombinations in the positive column. In such prior work, the positive column is obtained through the well-known Principle of Similarity. In such prior systems, the gaseous discharge occurs in a tubular structure for the ion/electron recombination on the walls of the tubular structure. Additionally, such prior work based on the Principle of Similarity dictates relationship between the length, diameter and pressure of the tubular structure which is extremely difficult to produce. In normal tubes, the length/diameter ratio approximates 30.0 and such prior work dictates that such ratio should be preserved. Where the length in the tube in such prior work is two orders of magnitude smaller than an available fluorescent tube, in order to maintain the prescribed ratio, the diameter correspondingly must be two orders of magnitude less and the pressure two orders of magnitude larger than that found in an available fluorescent tubular structure. Such conditions would be extremely difficult to produce with the known technology, and at the present time are not capable of being manufacturable. Another disadvantage in such prior art theory is directed to the directionality of the system. In such prior art theory, the eye of the observer must be aligned with the axis of the tube in order to observe an optimized light intensity. A still further disadvantage of such prior art theory, is that as the resolution is increased resulting in the tube diameter decreasing, it is extremely difficult to coat the inner wall of the tube uniformly with the Phosphor composition.

Other attempts to generate polychromatic displays based on the conversion of ultraviolet photons into visible light relies on the negative glow of the cathode. Such prior art work in this field has been published by M. Fukushiwa, Digest SID, P.120, 1975. However, just as in the case of the positive column type prior work, the Phosphor composition in this prior art theory using the negative glow is also immersed in the gas plasma which results in similar disadvantages, as has been previously described for the positive column approach. Additionally, a lower efficiency in generating ultraviolet light in the plasma with flat parallel cathode-anode electrodes, the spectrum of the visible light released by the gas ionization does not consist solely of ultraviolet light, but rather the spectral lines produced in the visible spectrum prevent color purity and color saturation due to color mixing of gas and Phosphorspectra.

Other prior art gas discharge type displays using hollow cathodes are represented in U.S. Pat. No. 3,882,342; and U.S. Pat. No. 4,021,695. As in the case of other types of work, such references use the back filling gas to produce ultraviolet radiation in the positive column. This type of theoretical approach suffers the same disadvantages as has hereinbefore been described. In opposition, the subject display system does not require the gaseous medium to produce a measurable amount of ultraviolet energy. The gaseous medium in the subject display system is used to sputter the atoms of metal from the cathode and the applied electric field ionizes such atoms to produce an intense ultraviolet glow. Such an ultraviolet glow produced from the ionization of the metal atoms is much greater than the intensity of the ultraviolet glow from a gaseous medium.

SUMMARY OF THE INVENTION

A display system which includes a cathode mechanism for producing energy in the ultraviolet bandwidth of the electromagnetic spectrum from ionization of metal atoms. The cathode mechanism defines a plate member having opposing first and second surfaces with the plate member having a plurality of openings formed therethrough. Each of the openings forms a sidewall having a metallic electrically conductive coating layered thereon. A dielectric film member having first and second opposing surfaces is bonded to the second surface of the plate member. The dielectric film member has a plurality of openings formed therethrough with each of the film member openings having an axis line substantially aligned with an axis line of each of the plate member openings. An anode mechanism is bonded to the second surface of the dielectric film member. The anode mechanism has an opening formed therethrough, with the anode mechanism opening defining an axis line substantially coincident with the plate member opening. A display panel is secured to the plate member first surface, and the display panel is substantially transparent to a bandwidth of the electromagnetic spectrum substantially comprising the ultraviolet spectrum. The display panel member has formed thereon a plurality of fluorescent material coatings for intercepting the ultraviolet energy from the ionization of the metal atoms, the coatings being in registration with the plate member openings. A back panel member is hermetically sealed to and displaced from the dielectric film member and the cathode mechanism forming a chamber therebetween. A gaseous medium is inserted within the internal chamber for ionization by an electrical field applied to both the anode and cathode mechanisms.

BRIEF DESCRIPTION OF THE DRAWINGS

FIG. 2 is a cross-sectional view of a cut-away portion of the display system taken along the section lines 2—2 of FIG. 1;

FIG. 3 is a cross-sectional view of the display system cut-away portion taken along the section lines 3—3 of FIG. 2;

DESCRIPTION OF THE PREFERRED EMBODIMENTS

Figure 1:
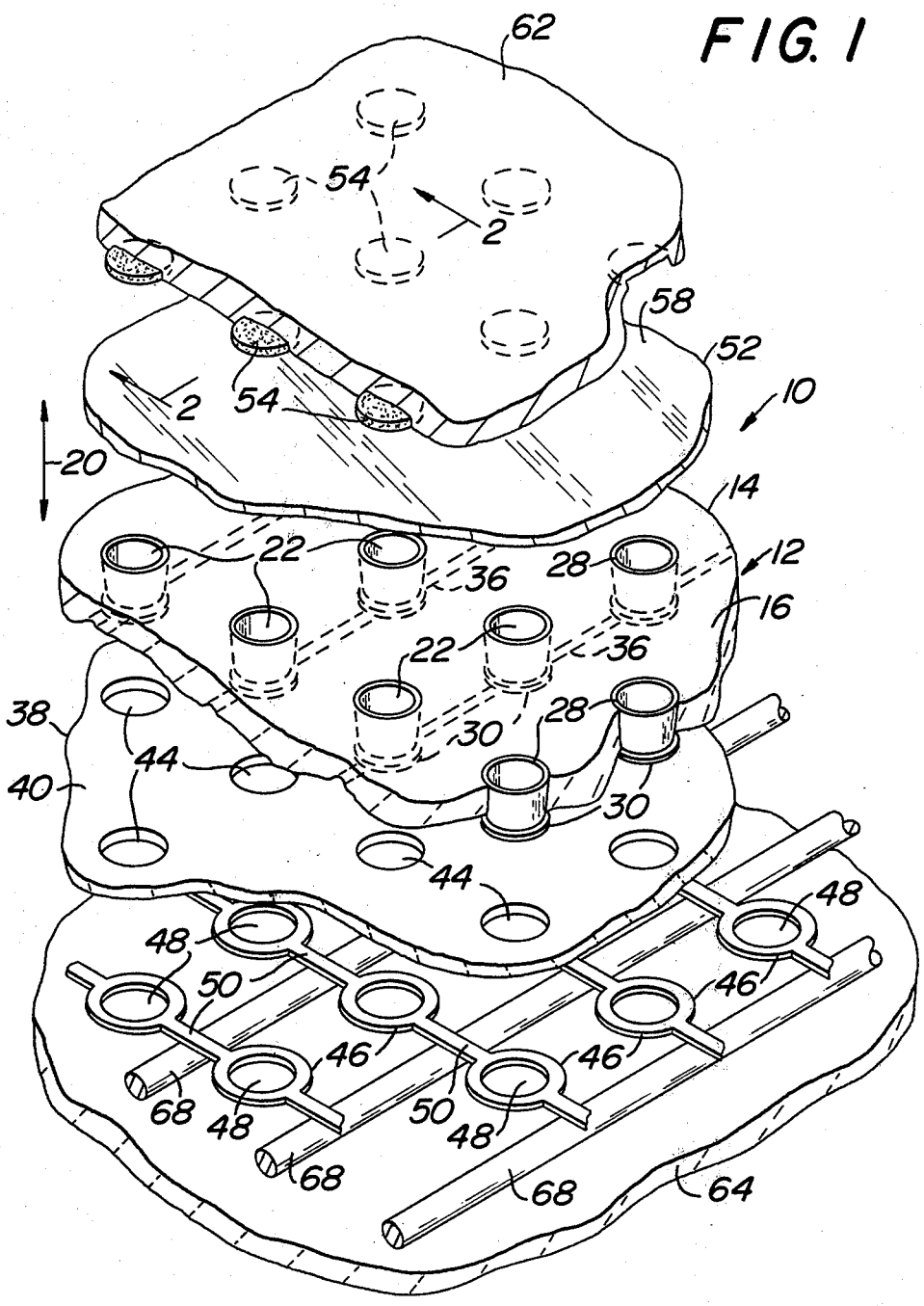
FIG. 1 is an exploded perspective view of a cut-away section of the display system.

Referring now to FIGS. 1–4, there is shown the basic structure of display system 10 which may either be monochromatic or polychromatic. In overall concept, display system 10 converts energy within the ultraviolet bandwidth of the electromagnetic spectrum into energy within the visible bandwidth of the electromagnetic spectrum through excitation of fluorescent materials. Prior systems in the field of plasma displays generally rely on the ionization of a noble gas or a mixture of gases between a pair of electrodes where the anode is generally transparent to the light energy generated in the neighborhood of the cathode when a voltage is applied between the anode and cathode. In complete opposition, the subject display system 10 is directed to the production of energy within the ultraviolet bandwidth of the electromagnetic spectrum responsive to the ionization of metal atoms. The ultraviolet energy which is not in the visible spectrum is then directed to a fluorescent material as will be explained in following paragraphs, and actuates such to provide a visual output.

The ultraviolet radiation being directed to the fluorescent material is generated by a gaseous plasma which originates in the negative glow captured in a cylindrically shaped cathode. As will be seen, the energy produced comes from ionized atoms of metal which is sputtered from the cathode surface and generally consists of the ionized metals largest spectral lines which are generally found in the ultraviolet bandwidth of the electromagnetic radiation spectrum.

Conceptually, and as will be further detailed in following paragraphs, a noble gas is ionized by application of a voltage potential between an anode and a cathode. Application of the potential ionizes the gas producing electrons and gaseous ions. The electrons are displaced toward the anode and the ions are displaced toward the cathode for impingement thereon. The cathode is formed of a metallic coating layer which when impinged by the ion, displaces an electron and subsequently an atom of the metal which is ionized. The atom of metal may be termed to be in a gaseous state and emits ultraviolet energy along its strongest spectral line.

The negative glow on the cathode thus provides the origination of the gaseous plasma which is confined within the cylindrical envelope of the cathode structure. The gaseous plasma includes the atoms of metal which are ionized and the particulates of metal sputtered from the cathode surface provides for the ultraviolet spectral radiation lines. When impinged by ionized or metastable atoms of a noble gas such as Argon, Neon, Krypton, or some like gas, a Nickel coated cathode would provide an intense radiation at approximately 2300 A°. The element Mercury would emit at a level of approximately 2500 A°, however, such would have approximately twice the intensity of the Nickel spectral line. A copper coated cathode would emit energy approximately four times as intense as the Nickel coated cathode, but at a spectral line of approximately 3200 A°. Additionally, other metals such as Aluminum would emit at approximately 3900 A° and Lead at 2200 A°, however, having different intensity levels.

Referring to the basic theory of operation of display system 10, such is directed to a hollow cavity cathode having a metallic coating layer formed on the sidewalls thereof. An annular extension of the metallic coating lies in a plane substantially parallel to an anode element displaced from the cathode mechanism. Upon application of a potential between the anode and the cathode, there is applied a predetermined voltage corresponding to the breakdown which is described in Paschen's Law, which essentially states that the breakdown potential between two terminals in a gas is proportional to the pressure times the gap length. Thus, the gap length is inversely proportional to the pressure of the gas. The current that flows is limited by the resistance provided in the circuit and if the current is limited to a low value, the glow that occurs is provided on the annular extension of the cathode mechanism.

In this phase, the gas is being ionized and generates electrons, metastables, and ions. Metastables as well as photons are neutral particles and the field has substantially no effect on them and their path direction is generally random. Thus, in flat parallel electrode systems, only a small number of metastables and photons are able to intercept the cathode and contribute to secondary emissions of electrons.

In opposition, the ion is attracted to the cathode and the electron produced is attracted to the anode. Ions intercept the surface of the cathode metallic coating, and if the ions have a sufficient energy they extract an electron from the cathode surface which initially must neutralize the ion. In the event that more than one electron is released during this operation phase, the extra electron is accelerated by the field in a displacement path toward the anode.

As the electron is displaced, it collides with gas atoms and additional ions are produced which progressively increases the current. The positive ions satisfying this process, therefore, have an energy at least twice the work function of the metal coating of the cathode. Photons of energy equal to or greater than the work function of the metal coating also extract electrons from the metal by photoelectric effect.

The work function for most clean surface metals is between 4.0 and 5.0 electron volts. This energy corresponds to ultraviolet radiation in the approximate bandwidth of 2500 to 3100 Angstroms. However, noble gases have low intensity of ultraviolet radiation compared to their radiation intensity in the visible portion of the electromagnetic spectrum. Such photons contribute minutely in producing secondary electrons from the radiative emission of the gases.

Subsequent to this phase of the operation, the series resistance placed between one of the electrodes, either the anode or the cathode and the supply energy is decreased. This secondary phase of the operation may be attained through well-known scanning mechanisms or in general, by modulation well-known in the art. When the resistance is decreased, the current that flows is greater than the current attained in the initial phase of the operation between the annular cathode section and the anode.

The glow now penetrates internal to the cavity of the cathode mechanism and the efficiency of producing secondary electrons is increased to the fact that the fraction of metastable atoms and photons reaching the cathodic surface is in the neighborhood of unity as compared to a fraction much less than 0.5 for flat parallel electrodes. Additionally, each electron will effect more collisions both ionizing and exciting prior to reaching the anode. Thus, the efficiency of the gas discharge is further increased and more electrons are produced. In this manner, there is provided more current as well as light energy.

It must be remembered that when system 10 is initially fired, there is a low current flowing between the annular section of the cathode and the anode elements. Thus, there is a small potential drop across the load resistance which is subtracted from the total voltage that is supplied from the source of energy. This represents the voltage that appears between the anode and cathode elements and corresponds to the striking voltage which is dependent on the pressure and the anode to cathode gap distance.

In the second phase of the operation, when a greater current flows through the system, then the voltage drop across the series resistance increases since there is a current that may be orders of magnitude greater than previously achieved in the first phase. Obviously, the drop of potential corresponds to the increase of the current. The voltage that now appears between the anode and the cathode would be smaller than the normal sustaining voltage that would be used between a parallel anode and cathode of the prior art. The glow between the annulus and the anode thus goes off, since it cannot be sustained, however, such is sustained within the cathode cavity. It is to be remembered that when a low current produces a glow between the annulus of the cathode and the anode, it is only the spectrum of the gas that is produced, there is little sputtering since the current is too low for that condition to occur. As soon as the glow penetrates internal to the cathode and the density of sputtering increases, atoms of metal are ionized which emit the ultraviolet radiation. It is thus the spectrum of the metal that is radiated and not the spectrum of the gas, as is generally provided in prior art systems.

Referring now to FIGS. 1–4, there is shown the overall structure of display system 10 which results in a monochromatic or polychromatic display system. It is to be understood that the exploded view shown in FIG. 1 is directed to the concept of separating the elements in a visual manner due to the complexity of the structure description. In actuality, display system 10 is formed into a hermetically sealed housing structure as is shown in FIGS. 2 and 3 in order to maintain the internal gases at a predetermined pressure, the concept of which is well-known in the art. Thus, display system 10 is generally formed into a monolithic type structure which greatly aids in optimizing display system 10, due to the high path accuracies of the energy, as well as the close tolerances needed in the overall construction as will be discussed in following paragraphs. Display system 10 includes cathode mechanism 12 which is used for producing energy in the ultraviolet bandwidth of the electromagnetic spectrum from ionization of metallic atoms. Cathode 12 defines cathode plate member 14 having opposing first and second surfaces 16 and 18 shown in FIGS. 2–4. Cathode plate member first and second surfaces 16 and 18 generally are planar in contour and form a plane substantially normal to a vertical direction defined by directional arrow 20 shown in FIGS. 2 and 3. Cathode plate member 14 is formed of a generally electrically insulating material such as glass, ceramic, or some like material not important to the inventive concept as is herein described. The thickness or dimension in vertical direction 20 of cathode plate member 14 may be within the approximate range of 0.060–0.170 inches with a typical thickness dimension of 0.080 inches. Various dimensional characteristics of display system 10 will be elucidated in following paragraphs to generally show scaling and relative dimensions between elements of display system 10 due to the fact that FIGS. 1–4 are greatly expanded in their conceptualization.

Each cathode plate member 14 includes a plurality of cathode openings 22 formed therethrough extending in vertical direction 20, as is clearly seen in FIGS. 1–3. Each of cathode openings 22 includes cathode opening axis lines 24, each of which extend in vertical direction 20. In general, cathode openings 22 define a substantially circular contour in a plane normal to axis line 24 of each of cathode plate member openings 22.

As is clearly seen in FIGS. 2 and 3, cathode through openings 22 generally provide a cross-sectional area at cathode plate member first surface 16 which is larger than the cross-sectional area at opposing cathode plate member second surface 18. In this manner, cathode plate member openings 22 are seen to form a truncated cylindrical cone contour. Each of cathode through openings 22 in combination with surrounding cathode plate member 14 define cathode through opening sidewalls 26 which are inclined. The inclination in upward vertical direction 20 provides an angle with respect to axis lines 24 within the approximate range of 1.0°–5.0° with a preferred angle of inclination approximating 3.0°. Although cathode openings 22 may be formed in a non-inclined cylindrical contour, it has been found that inclination of cathode opening sidewalls 26, as herein described, optimizes the directional displacement of the ultraviolet energy formed from the ionization of metallic atoms in an upward vertical direction 20 to impinge on fluorescent material to be described in following paragraphs.

Each of cathode opening sidewalls 26 of cathode openings 22 includes a metallic coating 28 formed thereon. Metallic coating 28 may be formed of Aluminum, Nickel, or some like metallic coating which would allow ionization of metallic atoms displaced from the surface during the operation of system 10. Metallic coating 28 forms a metallic film on sidewalls 26 which may be in the approximate thickness range between 0.001–0.005 inches with a preferred and used thickness approximating 0.002 inches.

Cathode mechanism 12 further includes metallic coating annular portion 30 formed in an annular contour, as is seen in FIGS. 1–3 and bonded to cathode plate member 14 at second surface 18. Metallic coating annular portion 30 surrounds each of plate members 14 at the lower portion of each of cathode openings 22. Metallic coating annular portions 30 may be and generally are in the preferred embodiment, formed of the same composition as metallic coating 28. Annular portions 30 are generally planar in contour and extend to a predetermined external diameter. Annular portions 30 and sidewall metallic coatings 28 may be formed in one-piece formation, or bonded each to the other separately, such not being important to the inventive concept as herein described with the exception that metallic coatings 28 and metallic coating annular portions 30 be electrically conductive and coupled each to the other in an electrical coupling mode. Thus, metallic coating annular portions 30 include an internal diameter substantially equal to a cross-sectional area of cathode plate member opening 22 adjacent second surface 18 of cathode plate member 14. Metallic coating annular portion 30 has a predetermined external diameter larger than plate member opening 22, with the external diameter to be discussed in following paragraphs in relation to other elements of system 10.

Figure 4:
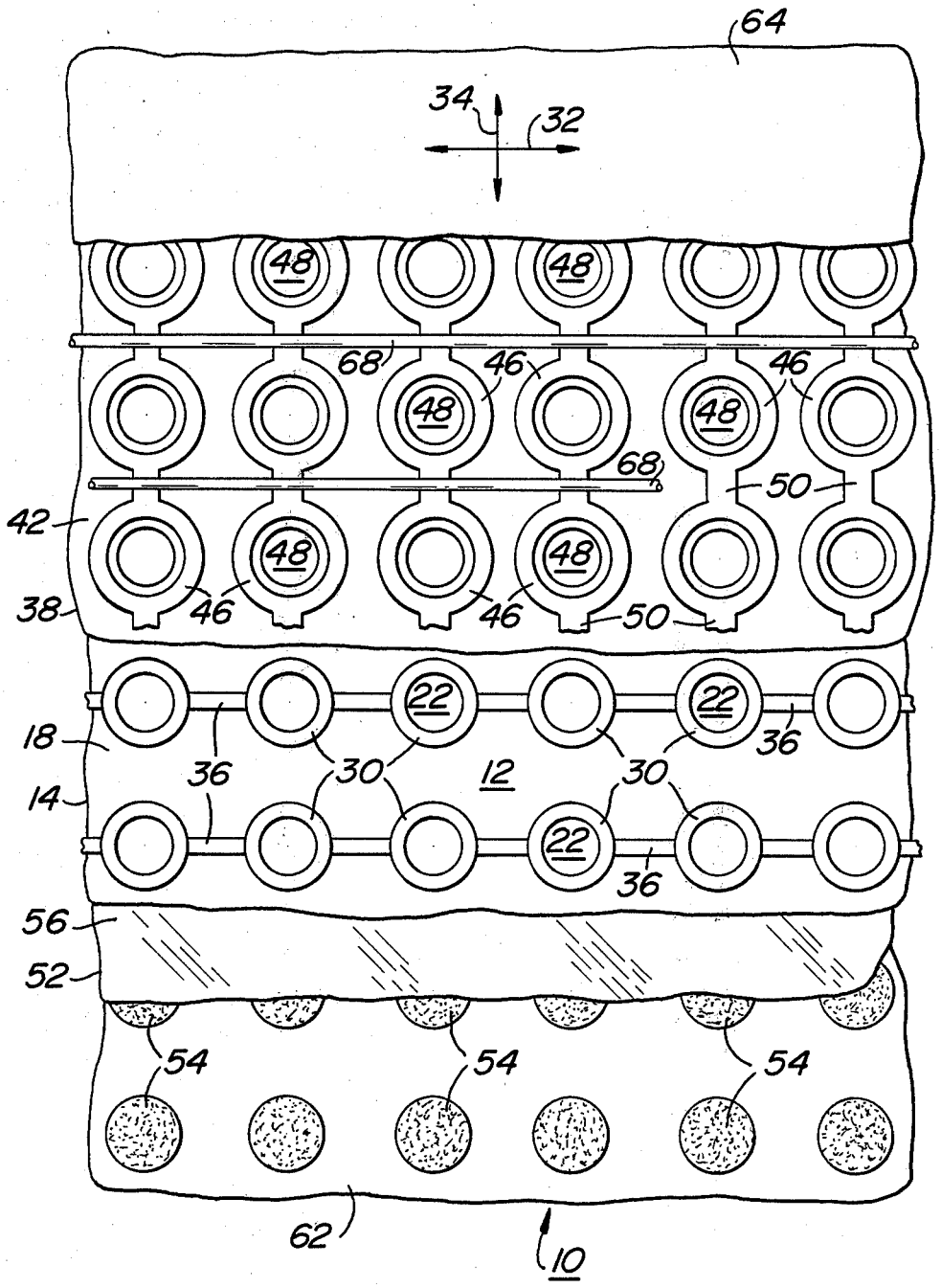
FIG. 4 is a plane view of the display system showing the vertical layers of the system; and, FIG. 5 is a structural schematic plane view of the display system showing alignment of fluorescent material with the anode and cathode elements of the display system.

Metallic coatings 28 and metallic coating annular portion 30 may be defined as the cathode elements of overall cathode mechanism 12. Additionally, the plurality of plate member openings 22 are seen to be formed in a matrix pattern within cathode plate member 14 defining rows and columns of plate member openings 22 which are common in the display system art. For purposes of ease of description, column direction 32 is shown in FIG. 4. Additionally, row direction 34 passes normal to column direction 32 and is also provided in FIG. 4.

In order to couple the cathode elements in column direction 32, metallic coatings 28 and 30 of each cathode opening 22 is electrically coupled to a next succeeding plate member opening metallic coating 28 and 30 in a particular column. To couple consecutive cathode elements, recess 36 shown in FIG. 3 and 4, is formed within second surface 18 of cathode plate member 14 extends in column direction 32. Recess 36 extends between successive plate member openings 22 formed in a predetermined column. Recesses 36 are filled with a continuous metallic film which is electrically conductive and may be formed of Aluminum, or some like electrically conductive composition. In this manner, metallic coatings 28 and 30 of particular openings 22 in a predetermined column are electrically coupled each to the other.

Referring to the dimensions of cavities or openings 22 shown in FIGS. 1–4, such may typically range between 0.10–0.005 inches in diameter, with a separation distance approximating 0.004 inches between peripheral sidewalls 26. Typically, an opening 22 having a 0.010 inch diameter would be separated from a next consecutive or adjacent opening 22 by approximately 0.014 inches to provide a resolution of 70.0 display areas or dots per inch.

Display system 10 further includes dielectric film member 38 having first and second opposing surfaces 40 and 42 formed in a planar contour. As can be seen in FIGS. 2 and 3, dielectric film member first surface 40 is bonded or otherwise securely fastened to second surface 18 of cathode plate member 14. Further, dielectric film member 38 includes a plurality of dielectric film member openings 44 formed therethrough with each of film member openings 44 having an axis line substantially aligned with axis lines 24 of each of plate member openings 22. Dielectric film member openings 44 are substantially aligned with metallic coating annular portions 30 and include a diameter substantially equal to the external diameter of annular portions 30. In this manner, openings 44 are insertable around each of annular portions 30, as is clearly evident in FIGS. 2 and 3. In general, dielectric film member first surface 40 is fused to cathode plate member second surface 18 or otherwise bonded in fixed securement thereto. Dielectric film member 38 is used as an electrical insulator and may be formed of a glass film or some like composition.

Display system 10 further includes a plurality of anode elements 46 bonded to second surface 42 of dielectric film member 38. As can clearly be seen in FIG. 1, anode elements 46 are generally annular in contour and are coupled each to the other in row direction 34. Anode elements 46 include openings 48 defining a vertically directed axis line coincident with cathode opening axis lines 24. Additionally, anode elements 46 include an internal diameter substantially equal to the external diameter of metallic coating annular portions 30 of cathode elements 12. Thus, the diameter of anode openings 48 are substantially equal to the diameter of the dielectric film member openings 44 as is clearly seen in FIG. 2. In this manner, a shoulder section is formed between metallic coating annular portion 30 and the internal surfaces of dielectric film member openings 44 and anode openings 48.

Anode elements 46 further include anode coupling elements 50 for electrically coupling a plurality of anode elements 46 in row direction 34 each with respect to the other. The purpose of anode coupling elements 50 is to electrically couple consecutively positioned rows of anode elements 46 each with respect to the other, as is shown.

Anode elements 46 and corresponding anode coupling elements 50 are formed of an electrically conducting material such as Aluminum, or some like metal which may be applied to dielectric film member second surface 42. In one form, anodes 46 and coupling elements 50 may be silk-screened to second surface 42 of dielectric film member 38. However, the basic mechanism of securing anode elements 46 and coupling elements 50 to dielectric film member 38 is not important to the inventive concept, with the exception that the method utilized provides for the fixed positional location of the elements, as has hereinbefore been described.

Display panel member 52 is secured to first surface 16 of cathode plate member 14. Display panel member 52, as will be described in following paragraphs, is substantially transparent to a bandwith of the electromagnetic spectrum substantially comprising the ultraviolet bandwidth. Additionally, display panel member 52 has formed thereon a plurality of fluorescent material coating 54 for intercepting ultraviolet energy from the ionization of metal atoms from metallic coating 28 within the cathode cavity.

Display panel member 52 includes opposing first and second surfaces 56 and 58, as is shown in FIGS. 2 and 3. Display panel member 52 is bonded or secured to cathode plate member 14 through sealing black glass frit film 60, shown in FIGS. 2 and 3. Film 60 provides a vacuum seal between display panel member 52 and cathode plate member 14 and further provides for substantial optical isolation of each cathode cavity when taken with respect to other cathode cavities formed adjacent thereto. Glass frit film 60 may have a vertical direction approximately within the range of 0.0005–0.001 inches. In order to apply frit film 60 to cathode plate member first surface 16, a printing screen may be used having openings corresponding to all but cathode openings 22. In this manner, panel member first surface 56 is bonded to cathode plate member first surface 16 in secured fashion.

Display panel member 52 is formed of an ultraviolet transparent glass having a dimension approximating 0.004 inches in thickness. Fluorescent material 54 is secured to panel member second surface 58 in registration above cathode openings 22. Thus, fluorescent material 54 includes a diameter substantially equal to cathode openings 22 and having axis lines coincident with cathode opening axis line 24. Fluorescent material 54 may be one of a number of compositions such as various Phosphor compositions, which radiate responsive to ultraviolet energy impinging thereon. A wide range of Phosphor compositions well-known in the art may be used as fluorescent material 54. Fluorescent material Phosphor elements 54 may be protected against abrasion by protective layer element 62. Layer element 62 may be a microsheet of glass, or such may be a metallo organic solution to form a coating of low refractive index and high abrasion resistance. Thus, protective layer element 62, as is seen in FIGS, 2 and 3, interfaces with both fluorescent material elements 54 and display panel member second surface 58.

Display system 10 further includes back panel member 64 displaced in axis line direction 24 from anode element 46 and dielectric film member 38. Back panel member 64 is in fixed displacement with respect to element 30 and 46 forming internal chamber 66, as is shown in FIG. 3. In order to maintain structural integrity of back panel member 64, frame rod members 68 extend in column direction 32, as is shown in FIGS. 2–4. Frame rod members 68 maintain a fixed spaced relation of back panel member 64 with respect to the structure of cathode plate member 14. Frame rod members 68 may be formed of glass having an approximate diameter of 0.010 inches. Frame rod members 68 are secured to back panel member 64 by adhesive means such as a frame paste, or some like material.

Back panel member 64 may be formed of a glass composition having a thickness within the approximating range of 0.060–0.120 inches. Back panel member 64 includes internal surface 70 which is coated with a film of Aluminum or like metallic coating which is generally specularly reflective in the ultraviolet. The metallic coating over back panel member internal surface 70 is continuous in nature and is used for providing an equipotential electrode as well as providing an ion collection element for ions escaping from cathode mechanism 12.

In order to insure a hermetic seal of the generally monolithic display system 10, as has herein been described, a frame of sealing glass frit may be screen printed around a common peripheral boundary in order to form a gas tight enclosure. One of frame rod member 68 may be formed in the overall peripheral contour of display system 10 and inserted between back panel member 64 and cathode mechanism 12.

Internal chamber 66 has a gaseous medium inserted therein to essentially fill the volume provided by the internal chamber 66, as well as cathode cavities. The gaseous medium is ionized by an electrical field applied to anode elements 46 and cathode mechanism 12. Gaseous ions impinging on metallic coating 28 sputter the metal atoms to produce ultraviolet energy, as has hereinbefore been described. The gaseous medium inserted internal to display system 10 is formed of a substantially inert gaseous composition and may be formed from the group consisting of Neon, Argon, Krypton, Xenon, or combinations thereof.

Back panel member 64 serves as a common or equipotential electrode. Due to the cylindrical contour of cathode mechanism 12, a minimum of sputtering exits from cathode openings 22. As is well-known, prior art plasma display sputtering forms deposits on the anode surfaces. However, with the electrode configuration as provided by metallic coating 28 and annular portion 30 of the subject display system, an electric field is established between common electrode or back panel member 64 and cathode annular portion 30. An electric field is also established between anode 46 and cathode annular portion 30. The field gradient which exists between back panel internal surface 70 and annular portion 30 is sufficient to attract metal atoms passing from cathode metallic coating 30 and such are deposited on internal surface 70 of back panel member 64 rather than on anode elements 46. However, the electrical field between back panel member internal surface 70 and annular portion 30 is not sufficient to initiate any discharge between the displaced but parallel electrodes defined by metallic coating annular portion 30 and internal surface 70 of back panel member 64. Due to the fact that internal surface 70 is reflecting and opaque in composition, surface 70 continues to reflect light which may escape from cathode cavities defined by the cathode openings 22.

Referring to the method of manufacturing discharge display system 10, as has hereinbefore been described, the initial step is in providing cathode mechanism 12 for producing energy in the ultraviolet bandwidth of the electromagnetic spectrum from ionization of metal atoms. A matrix of through or cathode openings 22 are formed in cathode plate member 14 which has opposing first and second surfaces 16 and 18, respectively. Through cathode openings 22 define cathode opening sidewalls 28 within plate member 14, as is clearly shown in FIGS. 2 and 3. As has been described, cathode plate member 14 is formed of an insulating material such as a glass or ceramic composition. A number of fabrication techniques may be used in forming cathode plate member 14 having appropriate cathode openings 22. In one method of fabrication, a molded plate of ceramic or glass having the appropriate matrix cathode openings 22 corresponding to a predetermined resolution may be formed. In such a molding type method, cathode plate member 14 may be produced by using a ceramic coating such as #528 ceramic from Aremco Products, Inc., or a fritted glass commonly referred to as #EE 10 from Owens-Illinois Company, have been successfully utilized. Another method of fabrication can easily be seen in providing cathode plate member 14 in continuous form and establishing a plurality of drill heads positionally located in the appropriate matrix alignment necessary to produce a predetermined resolution. In this type of fabrication, the drill heads would be tapered within the approximating range of 1°–5° with a preferred taper of 3°. Actuation of the drill heads in unison and contact as well as passage through cathode plate member 14 may be accomplished in one step, and provide the necessary through or cathode openings 22.

Subsequent to either the molding operation, the drilling operation, photoetching, or some like step to form cathode openings 22, the step of providing cathode mechanism 22 further will include the step of coating through opening sidewalls 26 with a metallic coating such as Aluminum, or some like metal. The step of coating sidewalls 26 with metallic coating 28 may be provided in a plurality of method steps. One step is by applying a metallic fluid paste on cathode plate member first surface 16 and compressively forcing the metallic paste through the through openings 22. This may be done by application of a squeegee, a roller mechanism, or some like device which would provide displacement characteristics to the metallic paste being used. The metallic paste would then be forcibly actuated or displaced within openings 22.

Another way in which costing of sidewalls 26 may be accomplished is by positioning a screen member over plate member first surface 16 wherein the screen member has a multiplicity of openings formed therethrough in axial alignment with cathode opening axis lines 24. As in the previous case, a metallic fluid paste is then inserted on an upper surface of the screen member and compressively displaced through the openings formed in the screen member. Whether the metallic paste is placed in direct contact with cathode plate member first surface 16 or applied to an upper surface of a screen member having the appropriate aligned openings, the metallic paste is then forced or displaced through the plate member openings 22.

The step of displacing the metallic paste through the openings 22 includes the step of applying a pressure differential between first and second surfaces 16 and 18 respectively of cathode plate member 14. A lower pressure is established at plate member second surface 18 when taken with respect to plate member first surface 16. In this manner, the metallic fluid paste is drawn through plate member openings 22 to form a metallic coating of predetermined thickness on sidewalls 26. The step of drawing the metallic paste through openings 22 may be accomplished in a variety of ways, one of which being to apply a low pressure vacuum pump suction surface at plate member second surface 18.

As has been previously described, plate member openings 22 may have diameters within the approximating range of 0.10–0.005 inches in diameter. Distances between cathode opening axis lines 24 may be adjusted to provide a separation between adjacent opening peripheries of approximately 0.004 inches which for a 0.010 inch diameter cavity would result in a separation distance of 0.014 inches to provide a resolution of 70.0 actuating spaces per inch. The thickness in vertical direction 20 of cathode plate member 14 may be within the range of 0.060–0.170 inches with a typical dimension of 0.080 inches. The printing screen previously described is commercially well-known in the art and would include a plurality of matrix openings aligned with cathode openings 22 in plate member 14. The openings within the printing screen would be positionally located in alignment with openings 22 and opaque throughout the remainder of the surface of the printing screen. A number of metallic fluid pastes may be utilized, one of which being a metallic fluid paste formed of an aluminum composition, such as #6110 manufactured by Electro-Oxide Corporation, or another paste formed of Nickel such as #9531 Nycil, produced by Dupont Corporation may be used. Although the metallic paste or ink passing through openings 22 may be produced by gravity assist, as has been stated, a moderate suction may be applied on second surface 18 of plate member 14, which would leave a film of metallic paste approximating 0.002 inches in thickness on sidewalls 26. It is to be understood that the film thickness may be controlled by adjusting the viscosity of the metallic ink in well-known manners.

The basic step of providing cathode mechanism 12 further includes the step of establishing metallic coating annular portions 30 on cathode plate member second surface 18. As may be seen, the formation of metallic coating 28 on sidewalls 26 may include the formation of annular portions 30, however, a number of fabrication techniques may be utilized in providing annular portion 30. The important concept being that annular portion 30 is coupled to coating 28 on sidewalls 26. Additionally, annular portions 30 are electrically coupled each to the other in row direction 34 by the inclusion of linearly directed recesses 36 formed within second surface 18 of cathode plate member 14. Recesses 36 may be formed by molding, milling, or some like technique not important to the inventive concept as herein described. Recesses 36 may then be filled with a metallic ink or paste to provide appropriate coupling between row directed annular portions 30.

The step of establishing annularly contoured metallic extension layers or annular portions 30 may include the step of masking plate member second surface 18 with a screen having screen openings formed therethrough. The screen openings are axially aligned with plate member openings 22 and the screen openings having a predetermined diameter greater than plate member through opening diameters at plate mamber second surface 18. A metallic coating layer may be applied to the masking screen and compressively interfaced in order to force the metallic coating paste through the openings formed in the masking screen.

Dielectric film member 38 is bonded to second surface 18 of cathode plate member 14. Dielectric film member 38 has a plurality of openings of predetermined diameter substantially equal to the external diameter of annular portions 30. Dielectric film member openings have an axis line which is aligned with axis lines 24 of each of the matrix of two openings 22 of plate member 14. Bonding of dielectric film member 38 may be provided by fusing, adhesive coupling, or some like technique not important to the inventive concept as is herein described. A masking screen having a negative type pattern in relation to openings 22 may be used for forming dielectric film member 38 on second surface 18 in a manner similar to that previously provided for application of metallic paste for metallic coatings 28.

Anode elements 46 are secured to dielectric film member second surface 42. Anode elements 46 include a plurality of annularly contoured configurations having an internal diameter which is substantially equal to the predetermined diameter of the openings formed in dielectric film member 38. Anode elements 46 are electrically coupled each to the other through anode coupling elements 50, as is clearly seen in the Figures. Once again, application of anode elements 46 and their associated coupling elements 50 may be applied through a masking screen type technique, well-known in the art.

The method of manufacturing or fabricating discharge display system 10 further includes the step of establishing display panel member 52 in bonded relation to first surface 16 of cathode plate member 14. Display panel member 52 includes a plurality of fluorescent material coatings 54 secured thereto. Coatings 54 are positionally located in registration with plate member through openings 22. A printing screen having formed thereon a negative pattern of the screen used to fill through openings 22 is used to deposit a film of sealing black glass frit 60 to a thickness approximately within the range of 0.0005–0.001 inches. Black glass frit film 60 provides a vacuum tight seal between cathode plate member 14 and display panel member 52.

Display panel member 52 is composed of substantially an ultraviolet transparent glass having a thickness approximating 0.004 inches. Display panel member 52 is commercially available and may be #75183A manufactured by Owens-Illinois Corp., or Microsheet #9741 manufactured by Corning Glass Work, Inc. The combination of display panel member 52, frit film 60, and cathode plate member 14 is fired with a uniform pressure maintained in a compressive state on panel member 52 in order to provide uniformity of sealing.

Prior to the registration of fluorescent material 54 in alignment with cathode openings 22, a frame of sealing glass frit may be screen printed on dielectric film member second surface 42 around the periphery of display system 10. The sealing glass frit which is printed may have a thickness within the approximate range of 0.0015–0.002 inches with a width dimension between approximately 0.1–0.2 inches. A glass rod member similar to the cylindrical contour of frame rod members 68 is deformed to assume the periphery of the sealing glass frit and is positionally located over the printed peripherally directed frit. The deformed glass rod may be maintained in place by frame paste being applied between surface 42 and the rod itself. A plurality of frame rod members 68 having a diameter within the approximate range of 0.009–0.010 inches are then positionally located and fixedly secured by the aforementioned frame paste. The entire panel system is then fired in a Nitrogen environment with a compressive pressure applied to the frame rod, as well as frame rod members 68 until the glass forms a glaze.

Back panel member 64 formed of a standard glass composition and having a substantially equal cross-sectional area to that of cathode plate member 14 is coated on internal surface 70 with a film of Aluminum, or some like metallic coating which is specularly reflective. The overall thickness of back panel member 64 may be within the approximate range of 0.060–0.120 inches. A peripheral frame of glass frit substantially identical to the frame glass frit secured to second surface 42 is deposited or otherwise coated on the metallic coating of internal surface 70. Cathode plate member 14 and back panel member 64 are placed in contiguous relation each to the other between a pair of flat carbon susceptors with the aforementioned panels being aligned each with respect to the other. The entire system is then placed in a vacuum environment to achieve a residual pressure approximating $10^{-7}$ mm of Hg where the system is then heated to a temperature approximating 450° C. for a predetermined time to eliminate various residual gases from the glass compositions.

At the time that pressure/temperature equilibrium is achieved, the vacuum environment is isolated from a pumping station and a inert gas or mixture of gas which may comprise approximately 98.0% Argon and 2.0% Krypton is inserted into internal chamber 66 to establish a pressure approximating 24.0–25.0 mm Hg, as an example, a 0.050 inch through opening 22. At the time that equilibrium in temperature is achieved with the particular gas being introduced, the temperature of the susceptors is raised to the softening point of the glass frit which makes up the sealing frame. Referring to the glass frit produced by Owens-Illinois Corp., the temperature is in the neighborhood of 530° C. When this limiting temperature is achieved by display system 10, the temperature is then lowered at a rate compatible with residual stress constraints.

The panel system now has applied to panel member second surface 58, a photographic emulsion composition layer which may be one of a number of photographic emulsion compositions, one of such being commercially available is referred to as Kodak Photo Resist. Anode elements 46 and predetermined cathode elements of cathode mechanism 12 are energized by voltage pulses in order to sensitize corresponding areas of the photographic emulsion composition above predetermined cathode openings 22. The energization is provided for positionally locating rows of the same color. In this manner, the photographic emulsion composition is formed into a tacky composition in an area intercepted by ultraviolet energy emitted from cathode openings 22. Of important consequence is that the area being energized is substantially axially in alignment with plate member openings 22 being energized defining the sensitized region.

The photographic emulsion composition is then removed from the unsensitized region of diplay panel member 52 by washing away the unsensitized photographic emulsion composition. Thus, there remains on surface 58 the predetermined areas which are aligned with openings 22. A fluorescent material composition is then applied to display panel 52 and the fluorescent material composition is adhesively captured by the sensitized photographic emulsion composition. The entire structure is then heated to permanently fix or secure the fluorescent material composition to the sensitized emulsion composition. The method steps are then repeated for each color in order to finally form a polychromatic display panel 52.

The step of heating is then followed by the step of applying a protective layer over the now fixed fluorescent material composition. The protective layer 62 may be a microsheet of glass or a metallo organic composition such as #GR650 produced by Owens-Illinois Corp., which forms a coating of low refractive index and high abrasion resistance.

Figure 5:
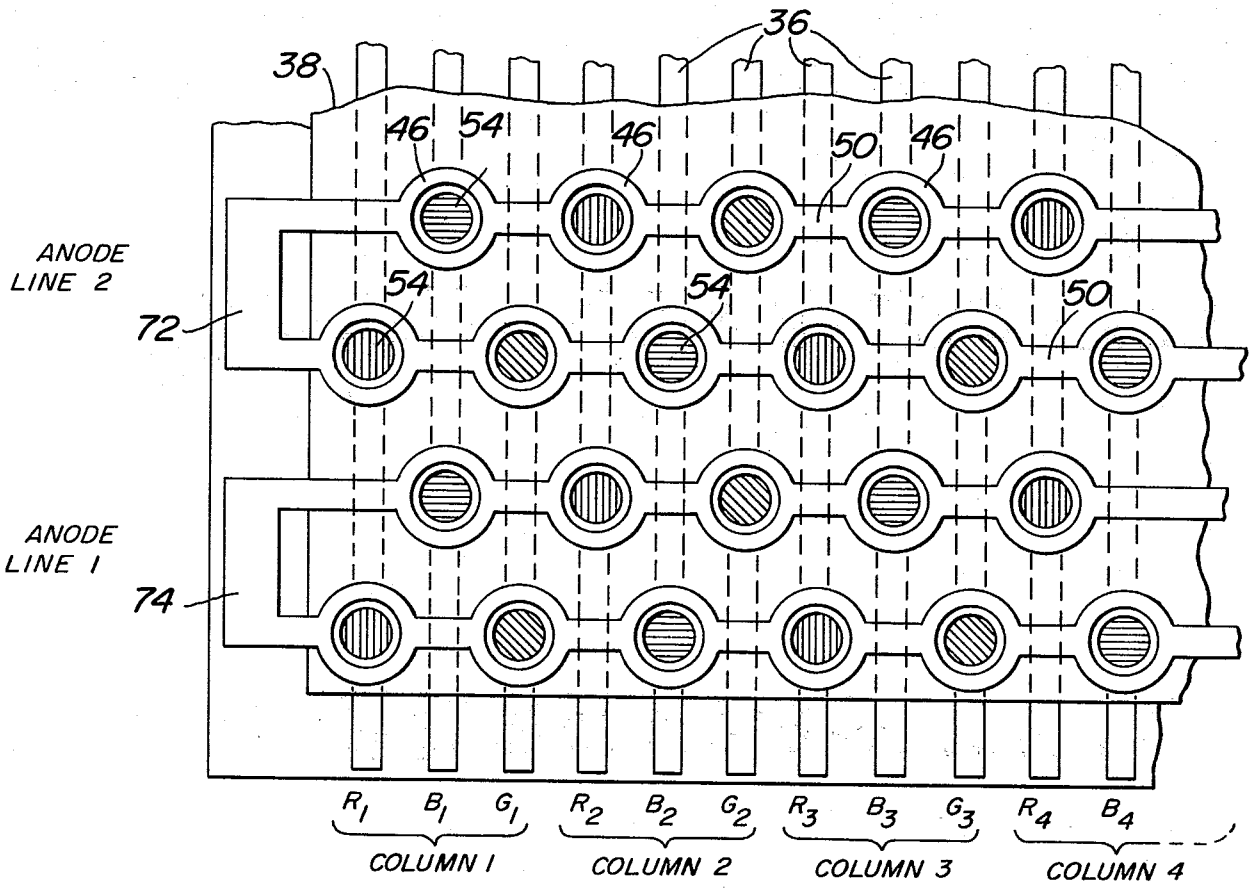

FIG. 5 is presented to provide clarification of the alignment and coupling of cathode mechanism 12 and anode elements 46. It is to be understood, that this Figure is not structurally drawn, but is used as a pictorial schematic to show alignment of the various elements when used in a polychromatic display system 10. As can be seen, there appears a pair of anode lines 72 and 74 directed orthogonal to cathode couplings 36 with appropriate fluorescent material compositions 54 applied at the intersection positional location. The various fluorescent material dots 54 are provided to produce the visible colors of red, blue, and green to achieve appropriate polychromatic visual displays.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A display system comprising:

(a) cathode means for producing energy in the ultraviolet bandwidth of the electromagnetic spectrum from ionization of metal atoms, said cathode means defining a plate member having opposing first and second surfaces, said plate member having a plurality of openings formed therethrough, each of said openings defining a sidewall having a metallic coating formed thereon;

(b) a dielectric film member having first and second opposing surfaces, said dielectric film member first surface being bonded to said second surface of said plate member, said dielectric film member having a plurality of openings formed therethrough, each of said film member openings having an axis line substantially aligned with an axis line of each of said plate member openings;

(c) anode means bonded to said second surface of said dielectric film member, said anode means having an opening formed therethrough, said anode means opening defining an axis line substantially coincident with said plate member openings;

(d) a display panel member secured to said plate member first surface, said display panel being substantially transparent to a bandwidth of the electromagnetic spectrum substantially comprising the ultraviolet spectrum, said display panel having formed thereon a plurality of fluorescent material coatings for intercepting said ultraviolet energy from said ionization of said metal atoms, said coatings being in registration with said plate member openings;

and, (e) a back panel member displaced from said dielectric film member and coupled thereto to form a hermetic seal.

2. The display system as recited in claim 1 including a gaseous medium in proximity to said metallic coating, said gaseous medium being ionized by an electrical field being applied to said anode and cathode means, said gaseous ions impinging on said metallic coating for ionization of said metal atoms for producing said ultraviolet energy.

3. The display system as recited in claim 2 where said gaseous medium is formed of a substantially inert gas composition.

4. The display system as recited in claim 2 where said gaseous medium is formed from the group consisting of Argon, Neon, Krypton, Xenon, Hydrogen or Helium.

5. The display system as recited in claim 1 where said plate member is formed of a substantially electrically insulating material composition.

6. The display system as recited in claim 1 where said plate member openings define a substantially circular contour in a plane normal to said axis line of each of said plate member openings.

7. The display system as recited in claim 6 where said plate member openings form a truncated cylindrical conical contour, said sidewalls being inclined in a manner to provide a cross-sectional area adjacent said display panel member larger than a cross-sectional area adjacent said dielectric film member.

8. The display system as recited in claim 7 where said sidewall inclination defines an angle with respect to said axis line direction within the approximate range of 1.0°–5.0°.

9. The display system as recited in claim 1 wherein said cathode means metallic coating includes an exterior portion bonded to said cathode means plate member second surface, said metallic coating extension portion surrounding each of said plate member openings.

10. The display system as recited in claim 9 where said coating extension portion is annular in contour having an internal diameter substantially equal to a cross-sectional area of said plate member adjacent said plate member second surface, said coating extension portion having a predetermined external diameter larger than said plate member opening.

11. The display system as recited in claim 8 where said plurality of plate member openings are formed in a matrix pattern within said plate member, said matrix pattern defining rows and columns of said plate member openings.

12. The display system as recited in claim 11 where said metallic coating of one of said plate member openings is electrically coupled to a next succeeding plate member opening metallic coating in said column.

13. The display system as recited in claim 12 including a metallic coating conductive member extending between and electrically coupled on opposing ends thereof to said metallic coatings of consecutive plate member openings formed in a predetermined column.

14. The display system as recited in claim 13 where said metallic coating conductive member is a metallic ink inserted within a recess formed within said plate member second surface, said recess extending between successive plate member openings formed in a predetermined column.

15. The display system as recited in claim 14 where said anode means includes an anode coupling member for electrically coupling a plurality of anode means associated with consecutively row positioned anode means each with respect to the other.

16. The display system as recited in claim 15 including anode row coupling means for electrically coupling consecutively positioned rows of anode means each with respect to the other.

17. The display system as recited in claim 1 where said metallic coating formed within said plate member openings are coupled to a metallic coating extension layer bonded to said plate member second surface, said metallic coating extension layer being annularly contoured having an internal diameter substantially equal to an associated plate member opening and having a predetermined external diameter.

18. The display system as recited in claim 17 where said dielectric film member openings are substantially axially aligned with said metallic coating extension layers, said dielectric film member openings having a diameter substantially equal to said metallic coating extension layer, said dielectric film member openings having a diameter substantially equal to said metallic coating extension layer external diameter.

19. The display system as recited in claim 18 where said dielectric film member is fused to said second surface of said plate member.

20. The display system as recited in claim 1 where said display panel member includes opposing first and second surfaces, said first surface of said display panel member being bonded to said first surface of said plate member.

21. The display system as recited in claim 20 where said display panel member is adhesively bonded to said first surface of said plate member.

22. The display system as recited in claim 21 where said fluorescent material is formed of a Phosphor composition.

23. The display system as recited in claim 20 where said display panel member second surface includes a protective coating layer applied over said fluorescent material coatings for abrasive protection.

24. The display system as recited in claim 1 where said back panel member is displaced in said axis line direction from said anode means and said dielectric film member forming a chamber therebetween, said back panel member including an internal surface facing said anode means and said dielectric film member.

25. The display system as recited in claim 24 where said internal surface of said back panel member is metallically coated.

26. The display system as recited in claim 25 where said metallic coating is specularly reflective.

27. The display system as recited in claim 26 where said metallic coating over said internal surface is continuous, said coated back panel for (1) providing an equipotential electrode, and (2) providing a collector for metal atoms escaping from said cathode means.

28. The display system as recited in claim 24 where said display panel member, said cathode means, and said back panel member are bonded at a common peripheral boundary forming a gas tight enclosure.

29. A method of manufacturing a display system including the steps of:

(a) providing a cathode means for producing energy in the ultraviolet bandwidth of the electromagnetic spectrum from ionization of metal atoms within a matrix of through openings formed through a plate member having opposing first and second surfaces, said through openings defining sidewalls within said plate member;

(b) bonding a dielectric film member first surface to said second surface of said plate member, said dielectric film member having a plurality of openings of predetermined diameter, each of said film member openings having an axis line substantially aligned with an axis line of each of said matrix of through openings of said plate member;

(c) securing anode means to a second surface of said dielectric film member, said anode means including a plurality of annular anode elements having an internal diameter substantially equal to said predetermined diameter of said dielectric film member openings;

(d) securing a back panel in fixed and axially displaced relation to said anode means and said dielectric film member; and, (e) establishing a display panel member in bonded relation to said plate member first surface, said display panel member having a plurality of fluorescent material coatings secured thereto, said coatings being in registration with said plate member through openings.

30. The method of manufacturing a display system as recited in claim 29 where the step of providing a cathode means includes the step of coating said through opening sidewalls with a metallic coating.

31. The method of manufacturing a display system as recited in claim 30 where the step of coating said sidewalls includes the step of applying a metallic fluid paste on said plate member first surface.

32. The method of manufacturing a display system as recited in claim 30 where the step of coating said sidewalls includes the steps of:

(a) positioning a screen member over said plate member first surface, said screen member having a plurality of openings formed therethrough in axial alignment with said plate member openings; and, (b) applying a metallic fluid paste on an upper surface of said screen member.

33. The method of manufacturing a display system as recited in claims 31 or 32 where the step of coating said sidewalls includes the step of displacing a metallic paste through said plate member through openings.

34. The method of manufacturing a display system as recited in claim 33 where the step of displacing said metallic paste includes the step of consecutively displacing said metallic paste internal said through openings of said plate member.

35. The method of manufacturing a display system as recited in claim 33 where the step of displacing said metallic paste includes the step of applying a pressure differential between said first and second surfaces of said plate member.

36. The method of manufacturing a display system as recited in claim 35 where the step of applying a pressure differential includes the step of establishing a lower pressure at said plate member second surface when taken with respect to said plate member first surface.

37. The method of manufacturing a display system as recited in claim 35 where the steps of applying a pressure differential includes the step of drawing said metallic fluid paste through said plate member openings to form a metallic coating of predetermined thickness on said opening sidewalls.

38. The method of manufacturing a display system as recited in claim 29 where the step of establishing a display panel includes the step of applying a photographic emulsion composition layer to an external surface of said display panel.

39. The method of manufacturing a display system as recited in claim 38 where the step of applying said photographic emulsion composition is followed by the step of energizing said anode and cathode means in a predetermined pattern for producing ultraviolet energy from predetermined plate member openings corresponding to a predetermined electromagnetic radiation bandwidth.

40. The method of manufacturing a display system as recited in claim 39 where the step of energizing said anode and cathode means includes the step of forming said photographic emulsion composition into a tacky composition in an area intercepted by said ultraviolet energy, said area being in substantially axial alignment with said plate member openings being energized, said area defining a sensitized region.

41. The method of manufacturing a display system as recited in claim 40 where the step of forming said photographic emulsion composition into a tacky composition is followed by the step of removing said photographic emulsion composition from said unsensitized region of said display panel member.

42. The method of manufacturing a display system as recited in claim 41 where the step of removing said unsensitized photographic emulsion includes the step of washing said display panel member with an aqueous solution.

43. The method of manufacturing a display system as recited in claim 41 where the step of removing said unsensitized photographic emulsion is followed by the step of applying a fluorescent material composition to said display panel, fluorescent material composition being adhesively captured by said sensitized photographic emulsion composition.

44. The method of manufacturing a display system as recited in claim 43 where the step of applying said fluorescent material composition is followed by the step of heating said display panel member for securely bonding said fluorescent material composition to said display panel member in alignment with said predetermined panel member openings.

45. The method of manufacturing a display system as recited in claim 44 where the step of heating is followed by the step of applying a protective layer over said heated fluorescent material composition.

46. The method of manufacturing a display system as recited in claim 29 where the step of providing a cathode means includes the steps of:

(a) forming a metallic coating on said sidewalls of said openings formed through said plate member;

and, (b) establishing an annularly contoured metallic coating extension layer secured to said annularly contoured metallic coating extension layer being in contact with said sidewall metallic coating.

47. The method of manufacturing a display system as recited in claim 46 where the step of establishing an annularly contoured metallic extension layer includes the step of masking said plate member second surface with a screen having screen openings formed therethrough, said screen openings being axially aligned with said plate member openings, said screen openings having a predetermined diameter greater than said plate member through opening diameter at said plate member second surface.

48. The method of manufacturing a display system as recited in claim 47 where the step of masking said plate member second surface is followed by the step of applying a metallic coating layer to said mask.

49. The method of manufacturing a display system as recited in claim 48 wherein the step of establishing said annularly contoured metallic extension layer is followed by the step of electrically coupling a plurality of successively positional metallic extension layers each to the other.

50. The method of manufacturing a display system as recited in claim 29 where the step of securing anode means to a second surface of said dielectric film member includes the step of masking said second surface of said dielectric film member with a screen having openings formed therethrough, said openings in said screen being axially aligned with said plate member through openings, said screen openings having a predetermined diameter greater than said dielectric film member openings.

51. The method of manufacturing a display system as recited in claim 50, where the step of masking is followed by the step of applying metallic paste to said mask for forming said anode means in annular contour.

52. The method of manufacturing a display system as recited in claim 29 wherein the step of securing a back panel is preceded by the step of coating said back panel with a reflecting metallic layer.

53. The method of manufacturing a display system as recited in claim 52 where said step of coating said back panel includes the step of applying a substantially specularly reflecting metallic layer to a panel surface facing said dielectric film member.

54. The method of manufacturing a display system as recited in claim 29 further including the step of hermetically sealing said back panel to said dielectric film member.

55. A method of radiating energy in the visible bandwidth of the electromagnetic radiation spectrum including the steps of:

(a) providing at least one hollow cathode element having internal sidewalls coated with a first metallic layer and a second metallic layer external said hollow cathode element;

(b) establishing at least one anode element displaced from said cathode element by a predetermined distance and having a gaseous medium contained therebetween;

(c) applying a first potential between said anode and cathode elements for ionizing said gaseous medium, said gaseous ions being displaced to said cathode element, said first potential including a predetermined potential corresponding to the breakdown voltage of said gaseous medium;

(d) applying a second potential between said anode and cathode elements, said gaseous ions bombarding said first metallic layer extracting at least one electron and at least one atom of metal, said metal atom being ionized and radiating in the ultraviolet bandwidth of the electromagnetic spectrum; and, (e) applying said ultraviolet radiation to a fluorescent material composition.

56. The method of radiating energy as recited in claim 55 where said step of applying said first potential includes the step of establishing a negative glow between said anode element and said second metallic layer of said hollow cathode element.

57. The method of radiating energy as recited in claim 56 where the step of applying said second potential includes the step of substantially extinguishing said negative glow between said second metallic layer and said anode element.

58. The method of radiating energy as recited in claim 56 where the step of applying said second potential includes the step of providing a second potential sufficient to maintain ionization of metallic atoms from said first metallic layer.

* * * * *